US008304640B1

(12) United States Patent
Barnfield et al.

(10) Patent No.: US 8,304,640 B1
(45) Date of Patent: Nov. 6, 2012

(54) METHOD AND APPARATUS FOR PROTECTING A MUSICAL INSTRUMENT

(76) Inventors: Gary D. Barnfield, Flower Mound, TX (US); Cathy Barnfield, Flower Mound, TX (US)

( * ) Notice: Subject to any disclaimer, the term of this patent is extended or adjusted under 35 U.S.C. 154(b) by 0 days.

(21) Appl. No.: 13/170,268

(22) Filed: Jun. 28, 2011

Related U.S. Application Data

(60) Provisional application No. 61/471,258, filed on Apr. 4, 2011.

(51) Int. Cl.
*G10D 9/00* (2006.01)

(52) U.S. Cl. ..... 84/453

(58) Field of Classification Search ..... 84/453
See application file for complete search history.

(56) References Cited

U.S. PATENT DOCUMENTS

| | | | | | |
|---|---|---|---|---|---|
| 312,804 | A * | 2/1885 | Brown | 206/314 |
| 1,084,719 | A * | 1/1914 | Wanamaker | 150/162 |
| 2,328,574 | A * | 9/1943 | Mueller | 84/382 |
| 3,635,117 | A * | 1/1972 | Nagao | 84/380 R |
| 3,748,946 | A * | 7/1973 | Runde | 84/380 R |
| D267,494 | S * | 1/1983 | Hardy | D17/22 |
| D278,442 | S * | 4/1985 | Whomsley | D17/20 |
| D285,778 | S * | 9/1986 | Smith | D9/434 |
| 4,880,130 | A * | 11/1989 | Blake | 220/655 |
| D308,217 | S * | 5/1990 | Cohen | D17/22 |
| 4,969,570 | A * | 11/1990 | Harvey, Sr. | 220/733 |
| D321,325 | S * | 11/1991 | Petrus | D9/435 |
| D322,717 | S * | 12/1991 | Wyant | D3/204 |
| D348,836 | S * | 7/1994 | McCallum et al. | D9/456 |
| D379,588 | S * | 6/1997 | Pledger et al. | D9/434 |
| 5,725,094 | A * | 3/1998 | Moral | 206/314 |
| 6,025,549 | A * | 2/2000 | Harris | 84/411 R |
| 6,177,622 | B1 * | 1/2001 | Green | 84/453 |
| 6,723,906 | B2 * | 4/2004 | Bourgoin | 84/411 R |
| 7,049,501 | B2 * | 5/2006 | Shellhammer et al. | 84/400 |
| 7,227,070 | B2 * | 6/2007 | Biba | 84/453 |
| 2004/0011186 | A1 * | 1/2004 | Hester, III | 84/453 |
| 2005/0257664 | A1 * | 11/2005 | Kessler | 84/453 |

* cited by examiner

*Primary Examiner* — David Warren
*Assistant Examiner* — Robert W Horn
(74) *Attorney, Agent, or Firm* — Kenneth L Tolar

(57) ABSTRACT

A method and apparatus for protecting a musical instrument includes a ring formed of an impact-absorbing material. A continuous notch on the inner circumference of the ring tightly receives the tubular rim of a particular instrument to anchor the ring thereto. The ring may include lights randomly positioned on the outer circumference to aesthetically enhance the instrument.

5 Claims, 1 Drawing Sheet

METHOD AND APPARATUS FOR PROTECTING A MUSICAL INSTRUMENT

CROSS REFERENCE TO RELATED APPLICATIONS

This application is entitled to the benefit of provisional application No. 61/471,258 filed on Apr. 4, 2011, the specification of which is incorporated herein by reference.

BACKGROUND OF THE INVENTION

The present invention relates to a method and apparatus for protecting the rim of a musical instrument.

DESCRIPTION OF THE PRIOR ART

Musical instruments, such as french horns, drums, trumpets or trombones, are often placed on an underlying surface when not in use. Consequently, dirt and debris abrade the rim and significantly diminish the useful life of the instrument. Furthermore, the rim is often inadvertently slammed against surrounding objects, causing further damage.

Accordingly, there is currently a need for a device that protects musical instruments from damaging abrasions. The present invention addresses this need by providing a protective ring that is secured to the rim of a select musical instrument to minimize impact damage thereto.

SUMMARY OF THE INVENTION

The present invention relates to a method and apparatus for protecting a musical instrument comprising a ring formed of an impact-absorbing material. A continuous notch on the inner circumference of the ring tightly receives the tubular rim of a select instrument to anchor the ring thereto. The ring may include lights randomly positioned on the outer circumference to aesthetically enhance the instrument.

It is therefore an object of the present invention to provide a device that protects a musical instrument.

It is another object of the present invention to provide a device that encompasses the rim of a musical instrument to prevent impact damage thereto.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
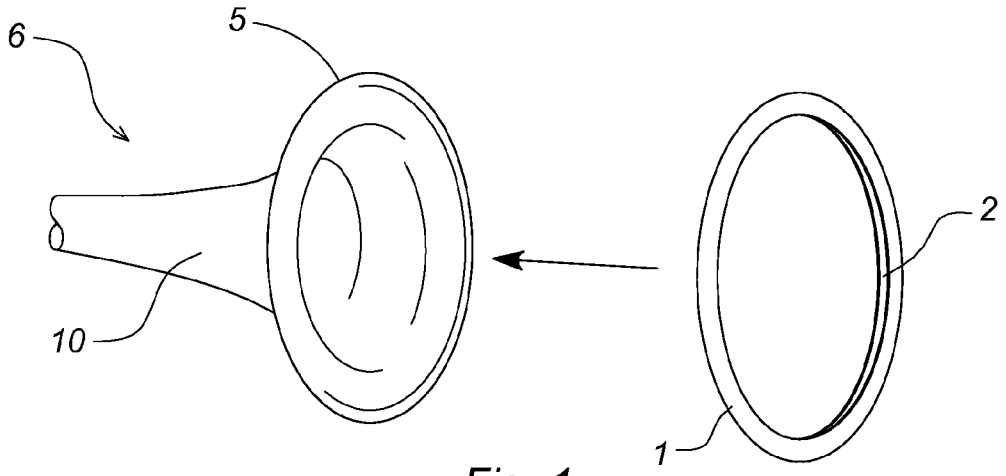
FIG. 1 is a perspective, sectional view of a musical instrument with the ring according to the present invention spaced therefrom.
Figure 2:
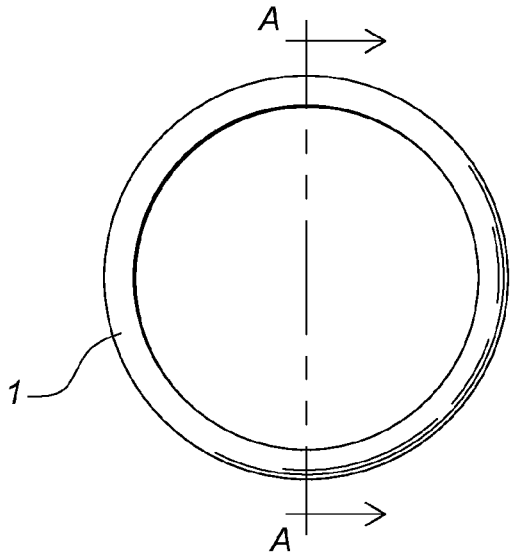
FIG. 2 is an isolated view of the ring.
Figure 3:
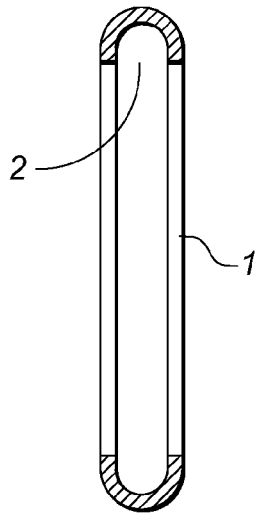
FIG. 3 is a sectional view of the ring taken along A-A in FIG. 2.
Figure 4:
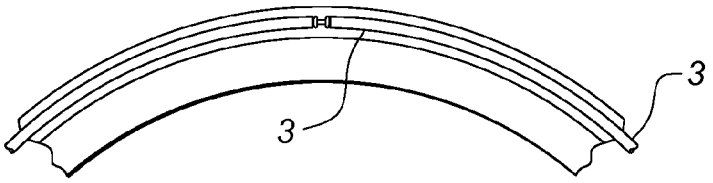
FIG. 4 is a sectional view of the ring depicting the internal light-pipe.

The present invention relates to a method and apparatus for protecting a musical instrument; wind instruments 6, such as french horns, trumpets or trombones, include an outwardly-flared bell 10 having a continuous tubular rim 5 thereon. Similarly, percussion instruments typically have an upper and/or a lower drumhead, each of which is surrounded by similar rim. The rim on such instruments is easily damaged when engaging other surfaces.

The apparatus according to the present invention is designed to protect the rim of a musical instrument of the type described above. The device comprises a ring 1 formed of silicone rubber or a similar impact-absorbing material. The ring includes an inner circumference and an outer circumference, both of which are substantially equal to that of the tubular rim 5 on a predesignated instrument. The inner circumference includes a continuous notch 2 that is dimensioned and configured to tightly receive the rim to anchor the ring to the instrument. The ring's circumference is somewhat expandable to accommodate the discrepancies in rim diameters that often occur among various instrument manufacturers.

To enhance the aesthetic appeal of the designated musical instrument, the ring may include lights randomly positioned on the outer circumference. For example, the lights could be formed of a frosted light-pipe 3 that is infused by a specifically-colored LED to emit light uniformly about the ring. Any other conventional light means could also be used or the ring could be constructed with a phosphorescent or similar material that glows in darkness. Accordingly, marching bands could perform in dark or dim conditions to create a unique, entertaining viewing experience whereby a spectator would only see moving, illuminated rings while listening to music. To further enhance the instrument's appearance, the ring may be infused with glitter.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. An apparatus for protecting a musical instrument comprising:

a ring formed of an impact-absorbing material, said ring including an inner circumference and an outer circumference, said inner circumference and said outer circumference substantially equal to a circumference of a tubular rim on a predetermined musical instrument;

a continuous notch on the inner circumference of said ring that is dimensioned and configured to tightly receive the tubular rim to secure said ring to said musical instrument.

2. In combination with a musical instrument having a continuous rim, an apparatus for protecting said instrument comprising:

a ring formed of an impact-absorbing material, said ring including an inner circumference and an outer circumference, said inner circumference and said outer circumference each having a circumference substantially equal to a circumference of said continuous rim;

a continuous notch on the inner circumference of said ring that is dimensioned and configured to tightly receive said rim to tightly secure said ring to said instrument.

3. The combination according to claim 2 further comprising lights randomly positioned on the outer circumference of said ring.

4. The combination according to claim 3 wherein said lights are formed of a light-pipe that is infused by a specifically-colored LED to emit light uniformly about said ring.

5. The combination according to claim 2 wherein said ring is constructed with a phosphorescent material.

* * * * *